US006183276B1

(12) United States Patent
Tsuji et al.

(10) Patent No.: US 6,183,276 B1
(45) **Date of Patent: *Feb. 6, 2001**

(54) CONNECTOR STRUCTURE AND ASSEMBLING METHOD FOR CONNECTORS

(75) Inventors: Masanori Tsuji; Osamu Sugiyama, both of Shizuoka-ken (JP)

(73) Assignee: Yazaki Corporation, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/274,974

(22) Filed: Mar. 23, 1999

(30) Foreign Application Priority Data

Mar. 25, 1998 (JP) ..... 10-077840

(51) Int. Cl.[7] ..... H01R 13/62
(52) U.S. Cl. ..... 439/157; 439/347
(58) Field of Search ..... 439/152, 153, 439/157, 342, 347, 372

(56) References Cited

U.S. PATENT DOCUMENTS 5,915,982 * 6/1999 Kashiyama et al. ..... 439/157
5,919,053 * 6/1999 Tsuji et al. ..... 439/157
5,938,458 * 8/1999 Krehbiel et al. ..... 439/157
5,964,602 * 10/1999 Aoki et al. ..... 439/157

FOREIGN PATENT DOCUMENTS 6-5148 1/1994 (JP) .
6-267610 9/1994 (JP) .
8-222331 8/1996 (JP) .
10-21991 1/1998 (JP) .

* cited by examiner

*Primary Examiner*—Brian Sircus
*Assistant Examiner*—Son V. Nguyen
(74) *Attorney, Agent, or Firm*—Finnegan, Henderson, Farabow, Garrett & Dunner, L.L.P.

(57) ABSTRACT

A connector structure includes a printed board (4), a connector (1) having a frame (11) in which terminals (3) are engaged and a mechanism member (2) being assembled to the connector (1). The mechanism member (2) is provided with a mechanism part (21) to draw a mating connector into the mechanism member (2). The mechanism member (2) and the connector (1) are constituted in different bodies. The mechanism member (2) is provided with a hood part (22) for engagement with the frame (11) of the connector (1). In assembling, the mechanism member (2) is assembled to the connector (1) after soldering the terminals (3) to the printed board (4).

20 Claims, 6 Drawing Sheets

CONNECTOR STRUCTURE AND ASSEMBLING METHOD FOR CONNECTORS

BACKGROUND OF THE INVENTION

1. Field of the Invention

The present invention relates to a connector structure having a mechanism member for mutually engaging multipolar male and female connectors with each other and a method of assembling the male and female connectors to each other.

2. Description of the Related Art

It is known that the use of a mechanism member for drawing one connector into another connector is one way in view of improving the operability in engaging the multipolar connectors having many terminals with each other. Japanese Unexamined Patent Publication (kokai) No. 6-267610 and Japanese Unexamined Utility Model Publication (kokai) No. 6-5148 discloses the conventional connector structures adopting the mechanism member.

In the former publication, there is shown a mechanism member of a general U-shaped cross section, which is provided, on upper and lower opposing faces thereof, with a plurality of cam grooves and attachment ribs. According to the disclosed structure, it is possible to assemble the above mechanism member to a male connector by sliding the member with respect to the male connector while respectively inserting the attachment ribs into grooves formed on top and bottom faces of the male connector.

While, a female connector shown in the publication has a plurality of terminals partially drawn out of a body of the female connector. The terminals are soldered to a printed board, so that the installation of the female connector on the board can be completed. In assembling, the male connector equipped with the mechanism member is temporary engaged with the female connector on the printed board and thereafter, the mechanism member 60 is slid in the longitudinal direction of the male connector 64. In this way, with the respective engagement of cam projections on the female connector with the cam grooves of the mechanism member, the male connector is fitted into the female connector.

In the latter publication, a female connector is provided, at the interior of a housing thereof, with upper and lower accommodation spaces into which a mechanism member is to be inserted. Similarly to the former publication, the mechanism member has a general U-shaped cross section and is provided, in opposing faces thereof, with cam grooves formed. In order to assemble the female connector to a male connector, the opposing faces of the mechanism member are inserted into the accommodation spaces through the side face of the female connector, so that the mechanism member is assembled to the female connector temporarily.

After assembling of the mechanism member, the female connector is integrated with a printed board by soldering terminals drawn out of the female connector to the printed board. On installation of the female connector on the printed board, the male connector is fitted to a front opening of the female connector temporarily. Subsequently, the depression of the mechanism member into the female connector in the lateral direction allows the mechanism member to draw the male connector, whereby the female connector and the male connector can be fitted to each other.

In common with the above-mentioned conventional structures, however, it is necessary that the connector being assembled to the mechanism member has a wide portion overlapping with the mechanism member due to the arrangement where the whole mechanism member is to be overlapped with the connector, thereby causing a depth of the connector to be lengthened. Furthermore, due to a large sliding area of the mechanism member with the connector, there is a problem of large sliding resistance, so that the smooth sliding of the mechanism member is obstructed.

In addition, there is a possibility that due to the structure where the connector is integrated with the printed board by soldering the terminals, the connector housing and the mechanism member are deformed by heat at the time of soldering. In such a case, the deformation may cause the sliding resistance in fitting to be increased, thereby causing the difficulty in fitting the male and female connectors to each other.

SUMMARY OF THE INVENTION

It is therefore an object of the present invention to provide a connector structure which is capable of decreasing an overlapping portion of the mechanism member with the connector and which does not influence the fitting of the male and female connectors in spite of thermal deformation occurring when soldering the terminals to the printed board, whereby the fitting of the connectors can be completed smoothly.

Additionally, it is another object to provide a method of assembling the male connector to the female connector in accordance with the above connector structure.

The former object of the present invention described above can be accomplished by a connector structure comprising:

a printed board;

a first connector having a frame in which one or more terminals are engaged, respective ends of the terminals being soldered to a wiring pattern on the printed board to assemble the first connector to the printed board; and a mechanism member being assembled to the first connector, the mechanism member having a mechanism part to draw a second connector being mated with the first connector into the mechanism member to fit the first connector and the second connector to each other;

wherein the mechanism member and the connector are constituted in different bodies, while the mechanism member is provided with a hood part which can engage with the frame of the first connector and which allows the mechanism member to be assembled to the first connector.

According to this invention, since the mechanism member is assembled to the first connector while the hood part of the mechanism member overlaps the frame of the first connector, it is unnecessary to put the mechanism part of the mechanism member on the first connector, whereby the depth of the connector can be reduced. Additionally, since the mechanism part for drawing the second connector thereinto is not overlapped with the connector, it is possible to reduce the sliding resistance between the first connector and the second connector, whereby the mechanism member can operate smoothly.

Furthermore, since the mechanism member and the first connector are constituted by the different bodies, the heat generated in soldering the terminals of the connector to the printed board does not act on the mechanism member. Therefore, there is no possibility that the function of the mechanism member to draw the second connector thereinto is influenced. That is, even if the first connector is deformed due to the heat at soldering, it is possible to fit the first connector to the mating connector smoothly.

In the present invention, preferably, the frame of the first connector is fixed on the printed board, while the frame is covered with the hood part in the completed assembly of the mechanism member and the first connector.

In this case, there is no need to put the mechanism part of the mechanism member on the printed board. Therefore, it is possible to reduce a portion of the printed board being occupied by the first connector, thereby reducing the size of the printed board.

In the present invention, preferably, the frame of the first connector is provided with at least one key, while the hood part of the mechanism member is provided with at least one key groove for slidable engagement with the key. In this case, owing to the engagement between the key and the key groove, it is possible to connect the hood part with the frame precisely and smoothly.

In the present invention, preferably, the frame of the first connector is provided with at least one projection, while the hood part of the mechanism member is provided with at least one engagement hole for engagement with the projection. In this case, owing to the engagement between the projection and the engagement hole, it is possible to connect the first connector to the mechanism member through the hood part and the frame. Therefore, the workability in assembling the connector and the mating connector can be improved.

In the present invention, preferably, the frame of the first connector is provided with at least one key groove, while the hood part of the mechanism member is provided with at least one key for slidable engagement with the key groove. Also in this case, owing to the engagement between the key and the key groove, it is possible to connect the hood part with the frame precisely and smoothly.

In the present invention, preferably, the frame of the first connector is provided with at least one engagement hole, while the hood of the mechanism member is provided with at least one projection for engagement with the engagement hole. Also in this case, owing to the engagement between the projection and the engagement hole, it is possible to connect the first connector to the mechanism member through the hood part and the frame. Of course, the workability in assembling the connector and the mating connector can be improved.

The latter object of the present invention described above can be accomplished by an assembling method for connectors, comprising the steps of: preparing a printed board and a first connector having a frame in which one or more terminals are engaged;

soldering the terminals to a wiring pattern on the printed board to assemble the first connector to the printed board;

preparing a mechanism member provided with a hood to draw a second connector being mated with the first connector into the mechanism member to fit the first and second connectors to each other; and putting the hood part on the frame to assemble the mechanism member to the first connector.

According to this assembling method, when soldering the terminals of the first connector to the printed board, the mechanism member has not been assembled to the connector yet. Therefore, the heat generated in soldering the terminals of the first connector to the printed board does not act on the mechanism member. Thus, there is no possibility that the function of the mechanism member to draw the second connector thereinto is influenced, whereby it is possible to fit the connector to the mating connector smoothly.

These and other objects and features of the present invention will become more fully apparent from the following description and appended claims taken in conjunction with the accompany drawings.

DESCRIPTION OF THE PREFERRED EMBODIMENT

Figure 1:
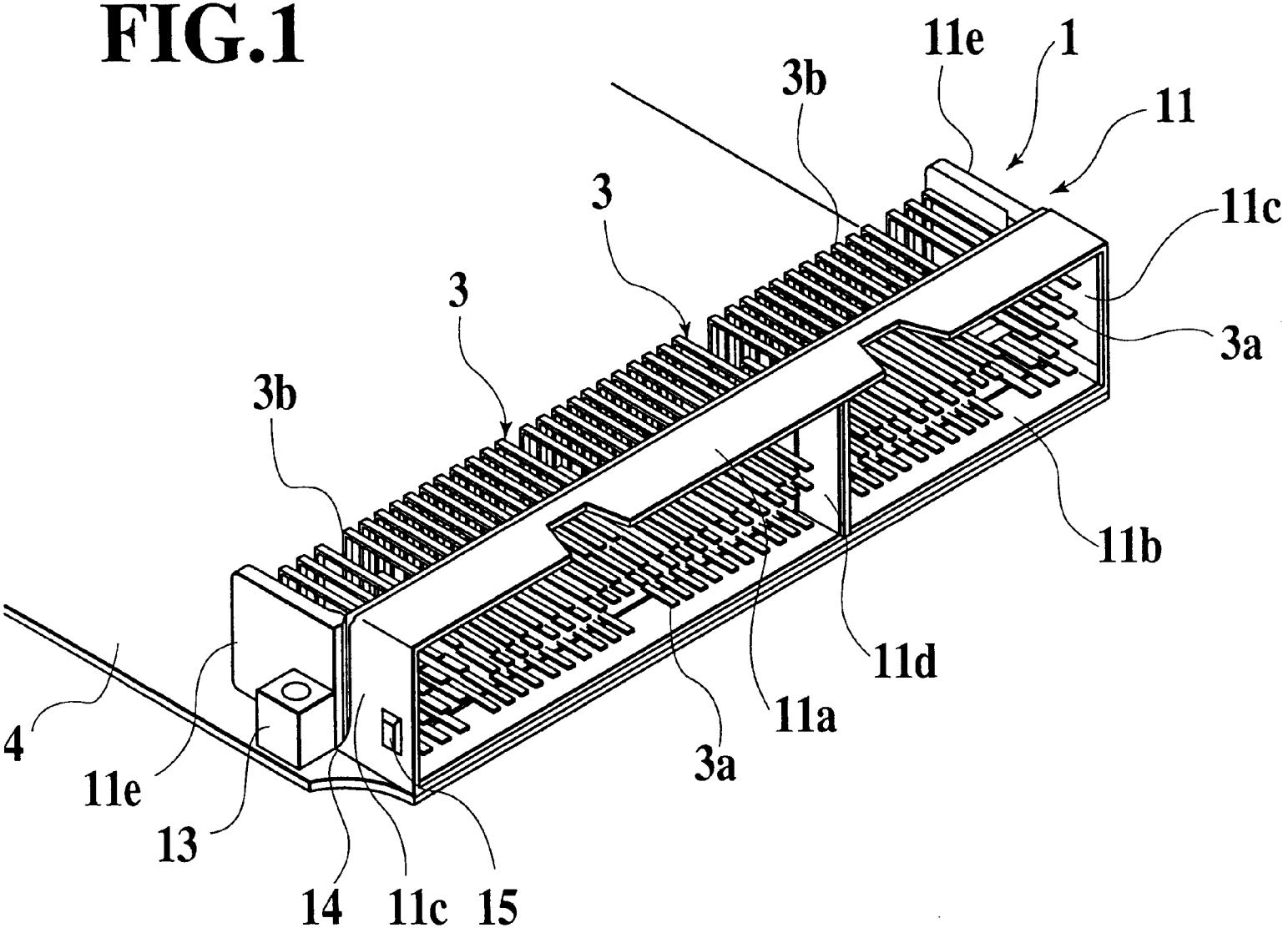
FIG. 1 is a perspective view of a connector in accordance with an embodiment of the present invention.
Figure 2:
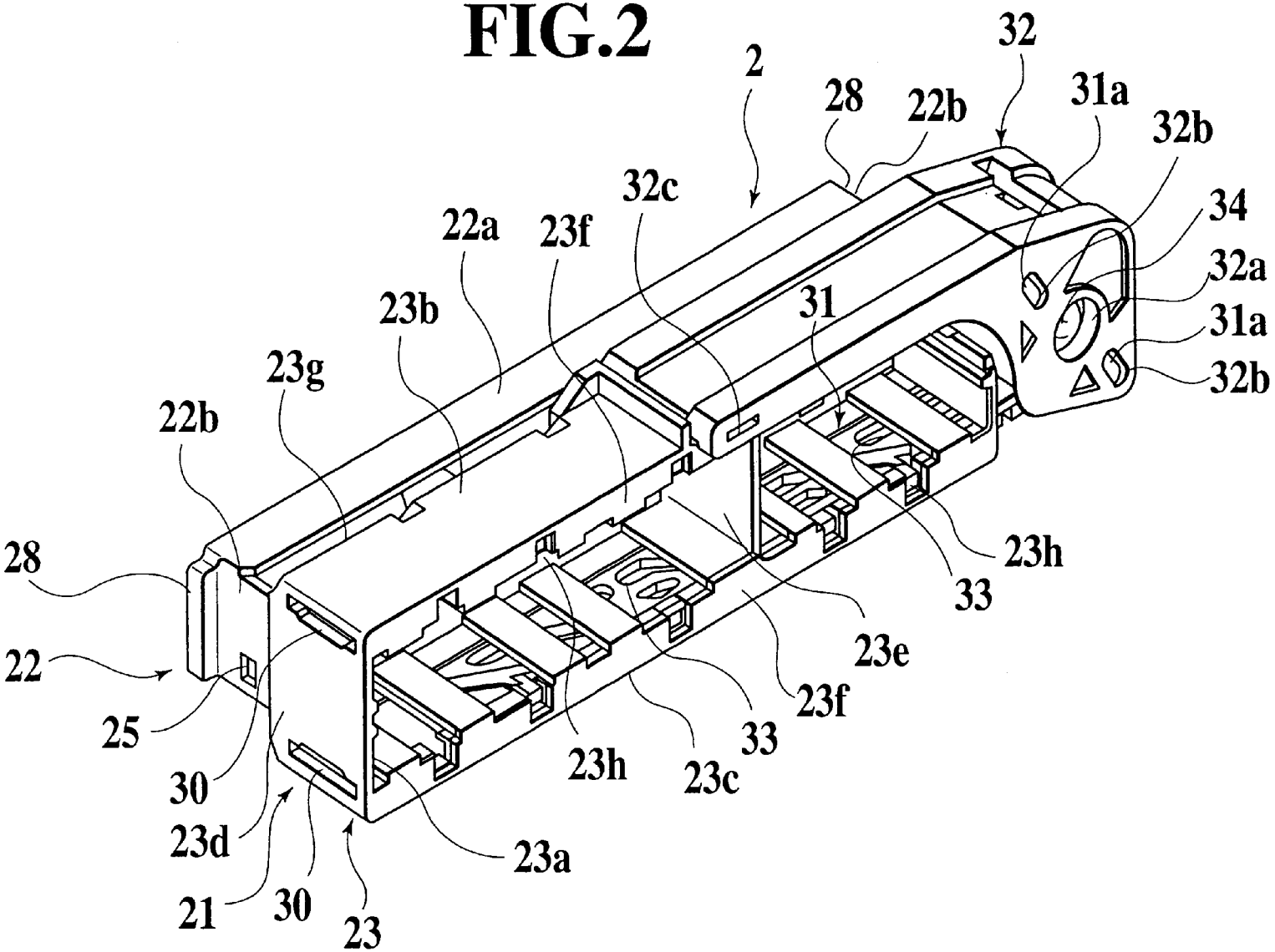
FIG. 2 is a perspective view of a mechanism member in accordance with the embodiment of the present invention.
Figure 3:
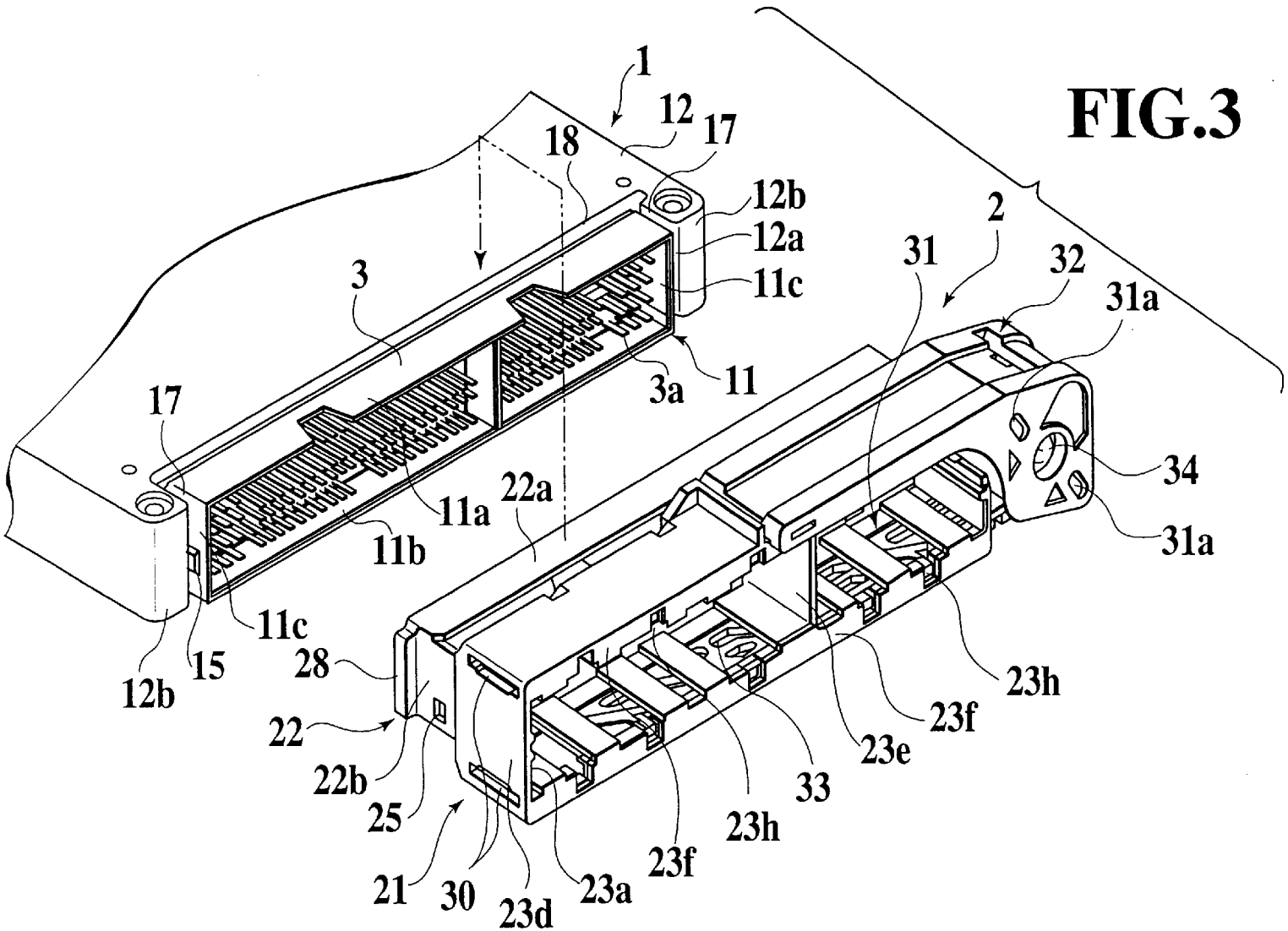
FIG. 3 is a perspective view showing a condition before assembling the mechanism member to the connector.
Figure 4:
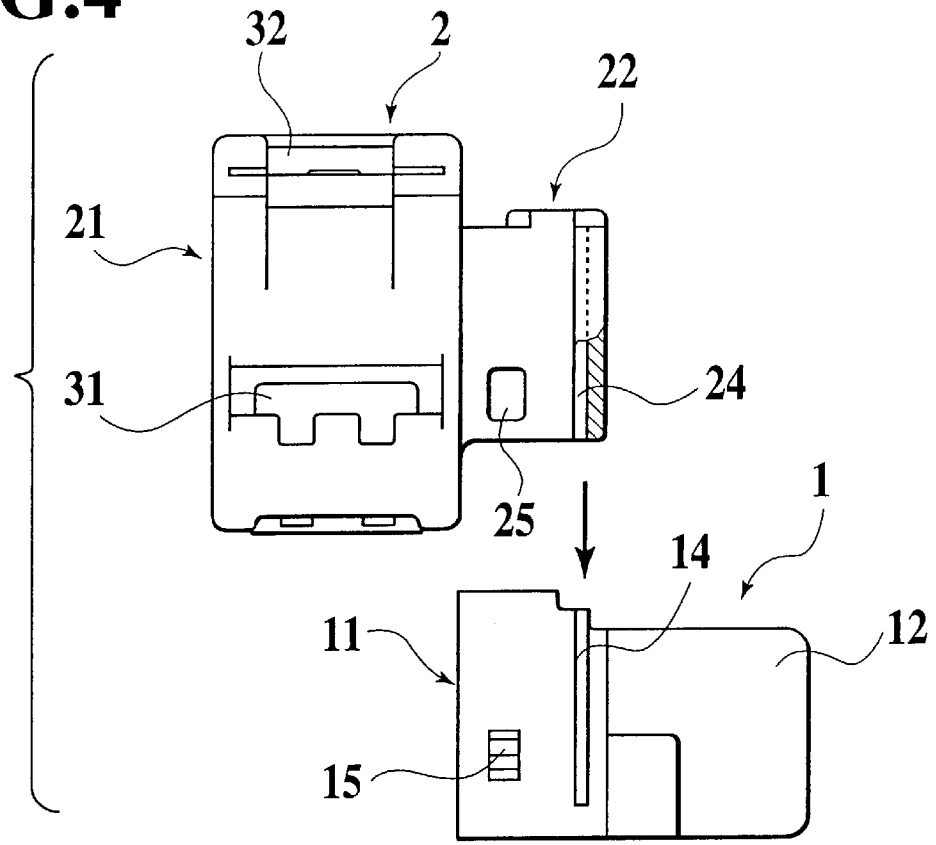
FIG. 4 is a side view showing the condition before assembling the mechanism member to the connector.
Figure 5:
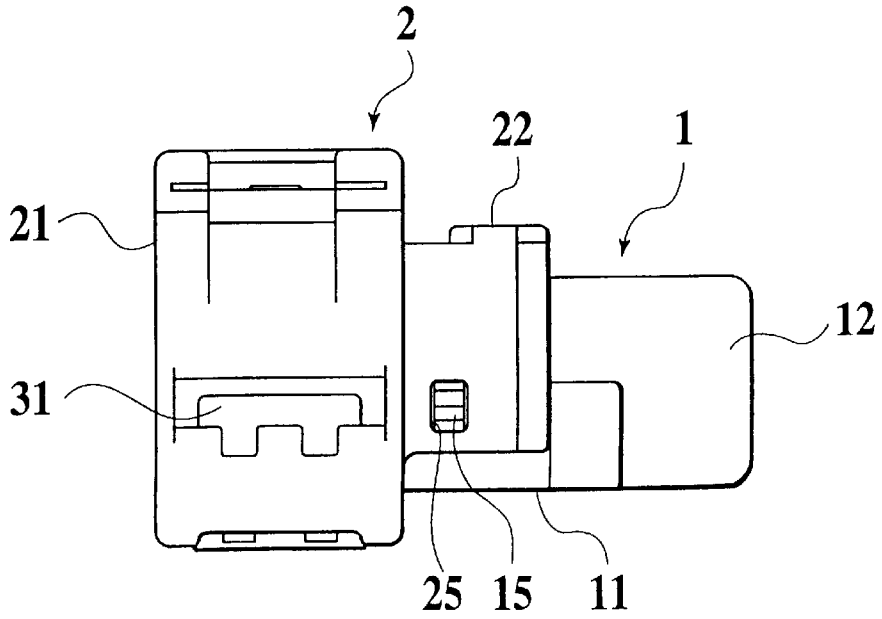
FIG. 5 is a side view showing a condition after the mechanism member has been assembled to the connector.

One embodiment of the connector structure and the assembling method of the connectors will be described with reference to the drawings. FIG. 1 is a perspective view of a first connector 1 of the connector structure of the embodiment of the present invention. FIG. 2 is a perspective view of a mechanism member 2. FIGS. 3 and 4 are perspective and side views showing an assembling operation, respectively. FIG. 5 is a side view showing the assembled condition.

The first connector 1 of the embodiment, which is a female connector to be mated with a male connector (not-shown second connector), includes a frame 11 on the front side and a casing 12 (FIG. 3) on the rear side, both of which are made of synthetic resin.

The frame 11 is in the form of a rectangular frame consisting of a top wall 11*a*, a bottom wall 11*b* and left and right sidewalls 11*c*, 11*c*. The interior of the frame 11 is divided into left and right chambers through a partition wall 11*d*. In addition, a pair of extension walls 11*e*, 11*e* are formed so as to extend backward from the sidewalls 11*c*, 11*c*, respectively. Each of the extension walls 11*e*, 11*e* is provided, in integral with an exterior face thereof, with a fixing block 13 for thread-engagement with a not-shown screw for fixing the frame 11 on a printed board 4.

On the boundary between the sidewalls 11*c*, 11*c* and the extension walls 11*e*, 11*e*, keys 14, 14 are formed to extend up and down of the frame 11. These keys 14, 14 engage with key grooves 24, 24 (mentioned later) formed on the side of the mechanism member 2. Furthermore, an engagement projection 15 is formed on an outer face of each sidewall 11*c* of the frame 11. The engagement projection 15 is engaged in an engagement hole 25 (also mentioned later) formed on the side of the mechanism member 2.

Figure 7A:
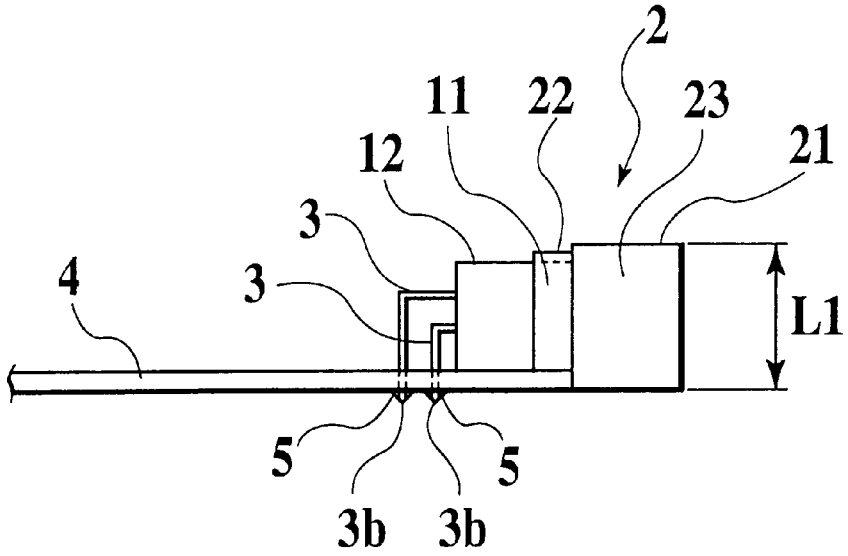
FIG. 7A is a side view for explanation of the structure of the connector structure of the embodiment.

Engageably retained in the frame 11 are a plurality of terminals 3 which are soldered to the printed board 4. Each terminal 3 is bent in L-shaped manner and has a leading contact 3*a* retained in the frame 11 to be connected to each mating terminal retained in the mating male connector. While, as shown in FIG. 7A, a rear contact 3*b* of each terminal 3 penetrates through the printed board 4 and is soldered to a pattern (not shown) on the printed board 4 for electrical connection.

The casing 12 arranged behind of the frame 11 is provided, on the front side, with an accommodating recess 12*a* for accommodating the frame 11. On both sides of the accommodating recess 12*a*, screw-taps 12*b*, 12*b* are formed to accept screws 16 (see FIG. 6) for thread-engagement with the casing 12.

The accommodating recess 12*a* of the casing 12 is formed to have a length (width) larger than that of the frame 11. Thus, when the casing 12 accepts the frame 11 therein, then a clearance 17 is defined between each sidewalls 11*c* and the casing 12. Respectively inserted into the clearances 17, 17 are a pair of sidewalls 22*b*, 22*b* constituting a hood part 22 of the mechanism member 2, which will be described later. Further, the accommodating recess 12*a* is provided, on a rear end thereof, with a flange groove 18 which is longer than the frame 11. The hood part 22 of the mechanism member 2 has a pair of flange ribs 28, 28 formed to engage in the flange groove 18. Owing to the engagement of the flange groove 18 with the flange ribs 28, 28, the assembling of the mechanism member 2 to the connector 1 can be guided to prevent the member 2 from disengaging from the connector 1 undesirably.

In assembling, after soldering the terminals 3 to the printed board 4, the frame 11 is secured on the board 4 by means of the screws through the fixing blocks 13, 13, as shown in FIG. 1. Next, the printed board 4 is overlaid with the casing 12 and thereafter, it is fixed on the board 4 by not-shown screws.

As shown in FIG. 2, the mechanism member 2 is constituted by a mechanism part 21 for drawing the mating male connector into the connector 1 and the hood part 22 for assembling the mating connector to the connector 1. Both of the mechanism part 21 and the hood part 22 are made of synthetic resin, integrally.

The mechanism part 21 comprises a cylindrical part 23 having a rear opening 23*a* through which the mating connector is to be inserted, upper and lower slide grooves 30, 30 formed on the cylindrical part 23, a pair of slide members 31, 31 which can slide in the slide grooves 30, 30 reciprocatively and a manipulating lever 32 allowing the respective slide members 31, 31 to reciprocatively slide for engagement or disengagement of the multi-polar female connector 1 with the mating male connector.

The cylindrical part 23 is in the form of an elongated rectangular cylinder which consists of top and bottom walls 23*b*, 23*c* and left and right sidewalls 23*d*, 23*d* opposing each other. The interior of the cylindrical part 23 is divided into two connector accommodating chambers through a partition wall 23*e* provide corresponding to the partition wall 11*d* of the connector 1.

Integrally standing from the top wall 23*b* are front and rear walls 23*f*, 23*g* between which an upper slide groove 30 is defined. Similarly, a lower slide groove 30 is also defined between the front wall 23*f* and the rear wall 23*g* both standing from the bottom wall 23*c*. Additionally, in the front walls 23*f*, a plurality of notch guides 23*h* are formed to introduce guide pins (not shown) of the mating connector into guide grooves 33 in the slide members 31, respectively.

The guide grooves 33 are formed in the opposite faces of the pair of slide members 31, 31. Each guide groove 33 is inclined to the sliding direction of the slide member 30 at a designated angle. The guide grooves 23 are adapted so as to engage with the guide pins of the mating connector, which are introduced through the notch guides 23*h*. With the sliding movement of the slide members 31, 31 while engaging the guide pins, the mating connector is drawn into the cylindrical part 23.

The manipulating lever 32 serves to reciprocatively slide the pair of slide members 31, 31 in the opposite directions to each other and has a pivot center hole 32*a* formed at a center of the base part of the lever 32.

Inserted into the pivot center hole 32 is a support shaft 34 which projects from the cylindrical part 23 and through which the manipulating lever 32 is rotatably supported up and down, by the part 23. In the manipulating lever 32, a pair of long holes 32*b*, 32*b* are formed on both sides of the pivot center hole 32*a*. While, the upper and lower slide members 31, 31 are respectively provided with column-shaped attachment bosses 31*a*, 31*a* which are inserted into the long holes 32*b*, 32*b* in the lever 32, respectively. By rotating the manipulating lever 20 up and down, the upper and lower slide members 31, 31 can be slid in the opposite directions to each other, in reciprocating motion.

Further, the manipulating lever 32 is provided, on its sidewalls close to the leading end, with rectangular engagement holes 32*c* for engagement with not-shown engagement protrusions of the cylindrical part 23. With the above structure, it is possible to lock the manipulating lever 32 on the cylindrical part 23.

The hood part 22 on the front side of the cylindrical part 23 has the interior communicating with the interior of the cylindrical part 23. The hood part 22 consists of a top wall 22*a* and the pair of sidewalls 22*b*, 22*b* hanging from left and right ends of the top wall 22*a*, providing a U-shaped element having an opened lower side. By inserting the frame 11 into the hood part 22 through the above opened lower side, the frame 11 is covered with the hood part 22.

As shown in FIG. 4, the hood part 22 is provided, inside both sidewalls 22*b*, 22*b*, with the vertical key grooves 24, 24 which engage the keys 14, 14 on the frame 11 of the connector 1, respectively. By sliding the hood part 22 along the frame 11 while maintaining the above engagement, the hood part 22 and the frame 11 can be mutually guided with no lateral slip, thereby completing to put the hood part 22 on the frame 11.

Again, the hood part 22 is provided, outside both sidewalls 22*b*, 22*b*, with the rectangular engagement hole 25, 25 which engage the engagement projections 15, 15 formed on the frame 11, respectively. With this engagement, the hood part 22 can be fixed on the frame 11. In this way, it is possible to assemble the mechanism member 2 to the connector 1.

Furthermore, on the outer faces of the sidewalls 22*b*, 22*b* of the hood part 22, the afore-mentioned vertical flange ribs 28, 28 are formed for engagement with the flange groove 18 in the casing 12 of the connector 1.

Next, we describe an assembling method of completing the connector structure in accordance with the embodiment.

First of all, as shown in FIG. 1, the frame 11 of the connector 1 is laid on the printed board 4. Then, the contacts 3*b* of the terminals 3 penetrate respective through-holes (not shown) formed in the printed board 4.

Thereafter, by screwing the frame 11 to the printed board 4 through the screws penetrating the fixing blocks 13, the frame 11 is secured on the printed board 4. Next, by allowing the frame 11 fixed on the printed board 4 to pass through a soldering bath, the respective contacts 3*b* of the terminals 3 are connected to a wiring pattern on the printed board 4 by means of solders 5, as shown in FIG. 7A. After that, the casing 12 is laid on the printed board 4 and fixed thereon by screws (not shown). In this way, it can be obtained the connector 1 installed on the printed board 4, as shown in FIG. 3.

Note, in the above-mentioned process of installing the connector 1 on the printed board 4, there is no possibility that heat or fever generated during the soldering process step acts on the mechanism member 2 because the connector 1 is not equipped with the mechanism member 2. Accordingly, the mechanism member 2 is prevented from being deformed by heat, thereby maintaining the normal condition.

Next, the mechanism member 2 is installed on the connector 1 from the upside. That is, as shown with arrows in FIGS. 3 and 4, the sidewalls 22*b*, 22*b* of the hood 22 are inserted into the clearances 17, 17 each defined between the frame 11 of the connector 1 and the casing 12, from the upside. Consequently, the frame 11 of the connector 1 enters into the hood part 22 through the opened lower side of the hood part 22. At this time, the hood part 22 does slide on the frame 11 downward while the keys 14, 14 on the connector 1 engages with the key grooves 24, 24 of the mechanism member 2, respectively. Therefore, in the sliding movement, the hood part 22 and the frame 11 can mutually slide smooth, without being inclined to each other. In addition, since the above-mentioned assembling does not require to move the mechanism member 2 and the connector 1 in two different directions but requires to slide the mechanism member 2 in one direction (downward), it is possible to carry out the assembling operation with ease.

Figure 6:
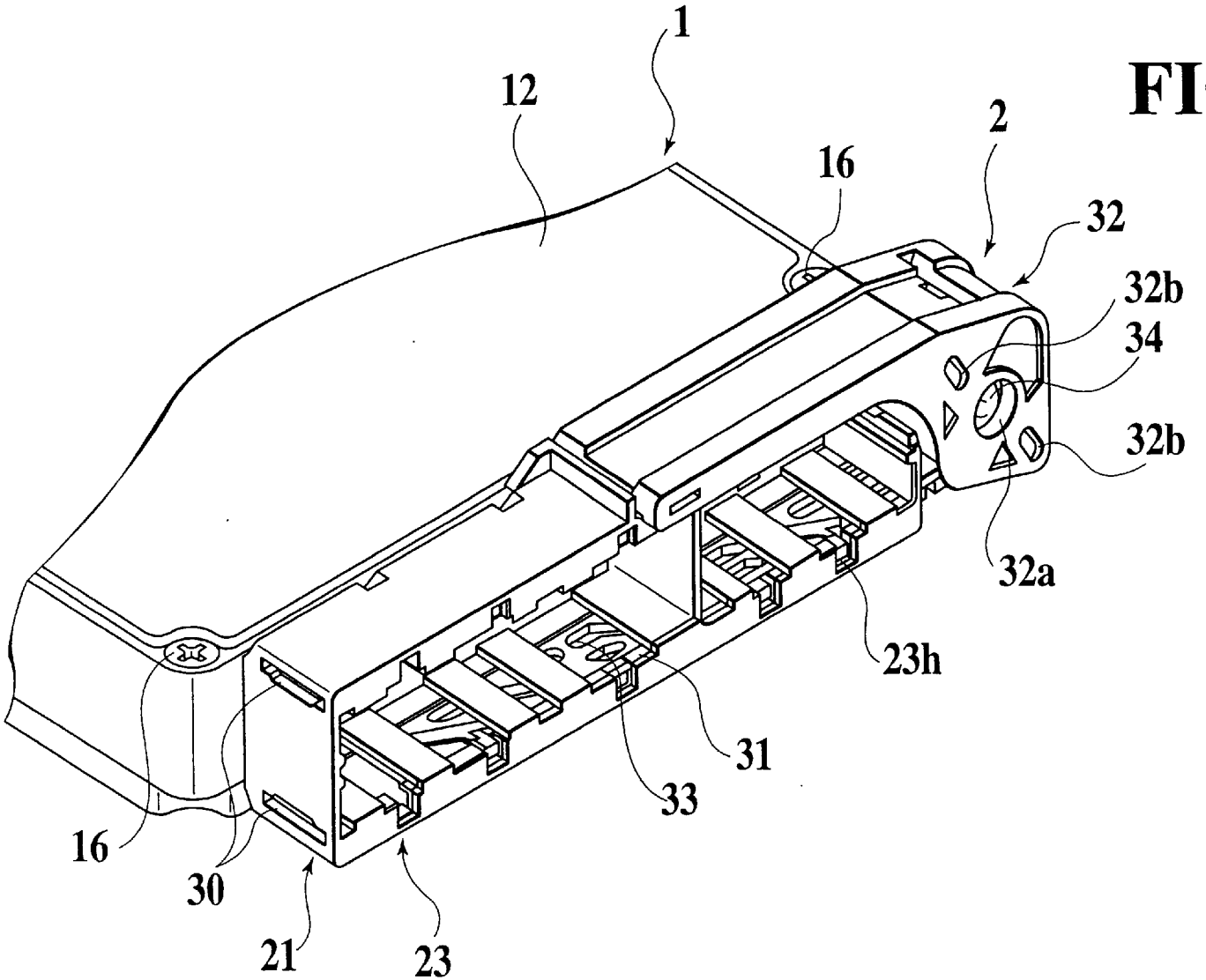
FIG. 6 is a perspective view showing the condition after the mechanism member has been assembled to the connector.

At the end of the sliding movement, the hood part 22 is engaged on the frame 11 with the engagement of the projections 15, 15 with the engagement holes 25, 25, so that the mechanism member 2 is assembled to the connector 1, as shown in FIGS. 5 and 6. Under such an assembling condition, since the frame 11 of the connector 1 is covered with the hood part 22, the mechanism member 2 constitutes a part of the housing of the connector 1. Note, since the flange ribs 28, 28 of the hood part 22 are engaged with the flange groove 18 of the connector 1 in this assembling condition, there is no possibility that the mechanism member 2 disengages from the connector 1 undesirably.

According to the embodiment, since the mechanism member 2 is assembled to the connector 1 while the hood part 22 of the mechanism member 2 overlaps the frame 11 of the connector 1, it is unnecessary to put the mechanism part 21 of the mechanism member 2 on the connector 1, whereby the depth of the connector 1 can be reduced. Additionally, since the mechanism part 21 and the connector 1 are provided independent of each other, their configurations are not complicated. Consequently, the sliding resistance of the slide members 31, 31 derived from the deformation during molding etc. can be reduced thereby to realize the smooth drawing of the mating connector into the connector 1.

Again, since the connector 1 and the mechanism member 2 are constituted by different bodies, it is possible to assemble the connector 1 to the printed board 4 under condition that the mechanism member 2 has not been assembled to the connector 1. Therefore, there is no possibility that the mechanism member 2 is deformed by the heat at the time of soldering. Thus, the mechanism member's function to drawn the mating connector is not influenced. Consequently, owing to the provision of such a mechanism member 2, it is possible to accomplish the fitting between the connector 1 and the mating connector, certainly.

Furthermore, since the mechanism member 2 is provided with the hood part 22 which overlaps the frame 11 of the connector 1 in the engagement relationship while the connector 1 and the mechanism member 2 are constituted by different bodies, it is possible to decrease the whole height of the connector structure including the connector 1 and the mechanism member 2

Figure 7B:
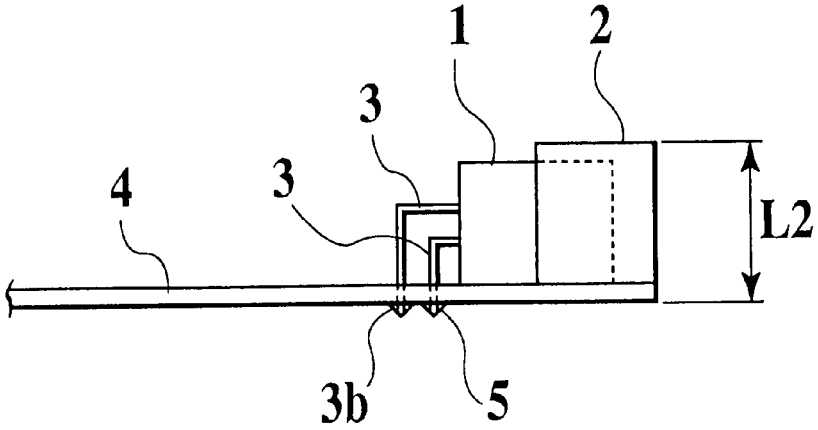
FIG. 7B is a side view of the comparative connector structure, for comparison with the structure of FIG. 7A.

FIGS. 7A and 7B are views for explanation of the above-mentioned effect.

When the mechanism member is provided without the above hood part 22, it is necessary that, as shown in FIG. 7B, the mechanism member 2 overlapping the connector 1 occupies the printed board 4, thereby causing a height L2 to be increased. On the contrary, when the hood part 22 overlaps to covers the frame 11 of the connector 1, there is no need to put the mechanism part 21 of the member 2 on the printed board 4, whereby a height L1 can be decreased in comparison with the height L2. Additionally, by the same reason, it is possible to reduce a portion of the printed board 4 being occupied by the connector 1 and alternatively, it is possible to miniaturize the printed board 4.

Although the female connector 1 is equipped with the mechanism member 2 in the above-mentioned embodiment, the male connector may be equipped with the mechanism member in the modification. Similarly, the above keys 14, 14 may be formed on the mechanism member 2 while providing the connector 1 with the key grooves 24, 24. Similarly, the above engagement projections 15, 15 may be formed on the mechanism member 2 while providing the connector 1 with the engagement holes 25, 25.

Finally, it will be understood by those skilled in the art that the foregoing description is related to one preferred embodiment of the disclosed connector structure and the assembling method, and that various changes and modifications may be made to the present invention without departing from the scope thereof.

What is claimed is:

1. A connector structure comprising:

a printed board;

a first connector having a frame in which one or more terminals are engaged, respective ends of the terminals being engaged with a wiring pattern on the printed board to assemble the first connector to the printed board;

a mechanism member being assembled to the first connector, the mechanism member having a mechanism part to draw a second connector being mated with the first connector into the mechanism member to fit the first connector and the second connector to each other; and wherein the mechanism member and the first connector are constituted in different bodies, while the mechanism member is provided with a hood part having an opened lower side which overlaps at least a portion of the frame of the first connector when the mechanism member is assembled to the first connector by inserting the frame into the hood part through the opened lower side such that when the hood part of the mechanism member is arranged on the printed board and remaining parts of the mechanism member is arranged off the printed board, a combined height of the hood part and a height of the printed board is generally similar to a height of the remaining parts of the mechanism member.

2. A connector structure as claimed in claim 1, wherein the frame of the first connector is fixed on the printed board, while the frame is covered with the hood part in the completed assembly of the mechanism member and the first connector.

3. A connector structure as claimed in claim 2, wherein the frame of the first connector is provided with at least one key, while the hood part of the mechanism member is provided with at least one key groove for slidable engagement with the key.

4. A connector structure as claimed in claim 3, wherein the frame of the first connector is provided with at least one projection, while the hood part of the mechanism member is provided with at least one engagement hole for engagement with the projection.

5. A connector structure as claimed in claim 2, wherein the frame of the first connector is provided with at least one key groove, while the hood part of the mechanism member is provided with at least one key for slidable engagement with the key groove.

6. A connector structure as claimed in claim 5, wherein the frame of the first connector is provided with at least one engagement hole, while the hood of the mechanism member is provided with at least one projection for engagement with the engagement hole.

7. A connector structure as claimed in claim 1, wherein the terminals are soldered to the wiring pattern on the printed board.

8. A connector structure as claimed in claim 1, wherein the hood part is formed integrally with the mechanism member.

9. An assembling method for connectors, comprising the steps of:

preparing a printed board and a first connector having a frame in which one or more terminals are engaged;

engaging the terminals to a wiring pattern on the printed board to assemble the first connector to the printed board;

preparing a mechanism member provided with an integral hood part having a opened lower side to draw a second connector being mated with the first connector into the mechanism member to fit the first and second connectors to each other; and putting the opened lower side of the hood part on the frame to assemble the mechanism member to the first connector such that when the hood part of the mechanism member is arranged on the printed board and remaining parts of the mechanism member is arranged off the printed board, a combined height of the hood part and height of and the printed board is generally similar to a height of the remaining parts of the mechanism member.

10. An assembling method of connectors as claimed in claim 9, wherein the terminals are soldered to the wiring pattern on the printed board.

11. An assembling method of connectors as claimed in claim 9, wherein the hood part overlaps at least a portion of the frame of the first connector when the mechanism member is assembled to the first connector.

12. A connector structure comprising:

a first connector having a frame mounted on a printed board; and a mechanism member constituting a different body than the first connector and that directly attaches to the first connector, the mechanism member having an integral hood part having an opened lower side that overlaps at least a portion of the first connector when the mechanism member and first connector are engaged by inserting the frame into the hood part through the opened lower side such that when the hood part of the mechanism member is arranged on the printed board and remaining parts of the mechanism member is arranged off the printed board, a combined height of the hood part and a height of and the printed board is generally similar to a height of the remaining part of the mechanism member.

13. A connector structure as claimed in claim 12, wherein the first connector further comprises a frame portion.

14. A connector structure as claimed in claim 13, wherein the hood part of the mechanism member overlaps at least a portion of the frame of the first connector.

15. A connector structure as claimed in claim 13, wherein at least one terminal is engaged with the first connector, an end of the at least one terminals being engaged with a wiring pattern on a printed circuit board to assemble the first connector to the printed circuit board.

16. A connector structure as claimed in claim 15, wherein the at least one terminal is soldered to the wiring pattern on the printed board.

17. A connector structure as claimed in claim 15, wherein the frame of the first connector is fixed on the printed board, while the frame is covered with the hood part in the completed assembly of the mechanism member and the first connector.

18. A connector structure as claimed in claim 15, wherein the frame of the first connector is provided with at least one key, while the hood part of the mechanism member is provided with at least one key groove for slidable engagement with the key.

19. A connector structure as claimed in claim 15, wherein the frame of the first connector is provided with at least one projection, while the hood part of the mechanism member is provided with at least one engagement hole for engagement with the projection.

20. A connector structure as claimed in claim 15, wherein the frame of the first connector is provided with at least one key groove, while the hood part of the mechanism member is provided with at least one key for slidable engagement with the key groove.

* * * * *

UNITED STATES PATENT AND TRADEMARK OFFICE

CERTIFICATE OF CORRECTION

PATENT NO. : 6,183,276 B1 
DATED : February 6, 2001
INVENTOR(S) : Masanori Tsuji and Osamu Sugiyama It is certified that error appears in the above-identified patent and that said Letters Patent is hereby corrected as shown below:

Column 8,
Line 58, "parts of the mechanism member is arranged"
should read -- parts of the mechanism member are arranged --.

Column 9,
Line 43, "parts of the mechanism member is arranged"
should read -- parts of the mechanism member are arranged --.
Line 45, "height of and" should read -- a height of --.

Column 10,
Line 14, "parts of the mechanism member is arranged"
should read -- parts of the mechanism member are arranged --.
Line 17, "remaining part" should read -- remaining parts --.

Signed and Sealed this

Twenty-fifth Day of February, 2003

JAMES E. ROGAN
*Director of the United States Patent and Trademark Office*